US005537687A

United States Patent [19]

Garza

[11] Patent Number: 5,537,687

[45] Date of Patent: Jul. 23, 1996

[54] PROTECTIVE FACE MASK SYSTEM USING VARYING THICKNESSES OF ENERGY ABSORPTION & DISSIPATION MATERIAL

[76] Inventor: Jaime Garza, 7703 Floyd Curl Dr., San Antonio, Tex. 78284

[21] Appl. No.: 137,503

[22] Filed: Oct. 15, 1993

[51] Int. Cl.[6] ..... A42B 3/18

[52] U.S. Cl. ..... 2/9; 2/206; 2/424; 2/425

[58] Field of Search ..... 2/6.3, 6.7, 9, 173, 2/206, 411, 412, 414, 413, 424, 425, 426, 427, 440, 448, 449, 909

[56] References Cited

U.S. PATENT DOCUMENTS

| | | |
|---|---|---|
| 3,729,745 | 5/1973 | Latina . |
| 3,787,895 | 1/1974 | Belvedere . |
| 3.934,271 | 1/1976 | Rhee . |
| 3,946,441 | 3/1976 | Johnson . |
| 4,662,005 | 5/1987 | Grier-Idris . |
| 4,847,920 | 7/1989 | Aileo et al. . |

FOREIGN PATENT DOCUMENTS

| | | |
|---|---|---|
| 471265 | 2/1951 | Canada . |
| 657057A5 | 8/1986 | Switzerland . |

*Primary Examiner*—Clifford D. Crowder
*Assistant Examiner*—Diana L. Biefeld
*Attorney, Agent, or Firm*—C. Emmett Pugh; Pugh/Associates

[57] ABSTRACT

A protective facial mask system having an outer, high impact, rigid layer (of, e.g., polycarbonate) and an inner, flexible, relatively soft layer of energy absorption and dissipating material (e.g. an unaerated viscoelastic polymer). The inner, soft layer preferably has variable or different thicknesses of material (e.g., going from about an eighth of an inch minimum to about a quarter inch maximum thickness), affording greater protection to facial areas where the underlying bone structure is weaker (e.g., the nasal region), which is where in the invention the inner layer is thickest, and thinner where the bone structure is stronger (e.g. over the flanking, supra-orbital/glabella regions). The inner soft layer thereby best absorbs, redirects and dissipates the energy from impact forces to the face, protecting the facial skeleton from, for example, fracturing. The mask, in all three of its embodiments (FIGS. 1 & 2, FIGS. 3 & 4, and FIGS. 7–10), covers the zygomatic, temporal, nasal and frontal bones, resting on the buttresses of the cranial facial area, while in the second embodiment (FIGS. 3 & 4), the mask also covers the maxilla and the sides of the mandible. At its upper perimeter, the mask extends above the supra-orbital ridges, leaving the remainder of the frontal bone, eyes, nostrils, and mouth of the user open. Shatter-proof lenses are positioned in oval openings at eye level and/or a separate goggle shield (303) used. The inner layer closely contacts and conforms to the contours of the person's face, preferably in face-to-face surface engagement.

26 Claims, 4 Drawing Sheets

PROTECTIVE FACE MASK SYSTEM USING VARYING THICKNESSES OF ENERGY ABSORPTION & DISSIPATION MATERIAL

TECHNICAL FIELD

The present invention relates to protective headgear, and more particularly to the protection of the face, particularly against point impact. The invention even more particularly relates to a protective facial mask system having an outer, high impact layer and an inner, soft layer in contact with the skin and supported on particular parts of the face with varying thicknesses of the inner layer for redistributing the impact forces to the parts of the face overlying the stronger bone structures.

BACKGROUND ART

It is not unusual to sustain facial injuries in high impact sports, such as basketball, hockey, baseball, and the like, or during various job-related activities, which expose the face of the user to impact with hard, un-yielding objects. Such objects most often result in damage to soft facial tissue, but can also cause fractures of underlying bones, which brings considerable pain and disfigurement to the injured person and requires extensive subsequent treatment. There is also the potential for damage to the orbital contents and the brain with such injuries.

When such injury is inflicted, it is often through a point or highly localized, which is received by one particular area of the face and is not dissipated throughout the remaining tissues of the face.

Various solutions have been offered to prevent, or at least limit, the force of impact on the face of a sportsman or industrial worker. Such solutions have included providing headgear, such as helmets, with face bars and helmets with outwardly extended shields which are attached to the headgear to protect the facial soft tissues and underlying bony skeleton.

However, in many sports it is inconvenient, if not entirely impossible, to use such helmets, since they impede the movements of the sportsman, interfere with other players, or in some way restrict a sportsman's viewing area.

It is therefore a general object of the present invention to provide a protective headgear, for a sportsman or other person, which protects the facial skeleton and does not have the drawbacks of the prior art.

Some prior patents and patent publications, which are considered pertinent to the invention, are outlined below:

| U.S. Pat. No. | Inventor(s) | Issue Date |
|---|---|---|
| 3,729,745 | Latina | 05/01/73 |
| 3,787,895 | Belvedere | 01/29/74 |
| 3,934,271 | Rhee | 01/27/76 |
| 3,946,441 | Johnson | 03/30/76 |
| 4,662,005 | Grier-Idris | 05/05/87 |
| 4,847,920 | Aileo et al | 07/18/89 |

| Country | Patent No. | Inventor(s) | Issue Date |
|---|---|---|---|
| Canada | 471,265 | Marietta | 02/06/51 |
| Swiss | CH 657 057 A5 | Strub | 08/15/86 |

It is noted that, in the disclosures of the above lists, only Rhee and Johnson mention the absorption of energy and both do so only in regard to helmets, a situation in which the headgear is of a uniform, curved shape, while the face has a variable, relatively complex topography with an underlying facial skeleton of variable bone thicknesses and strength. A primary point of the invention is the absorption and dissipation of energy to protect the facial skeleton, with all of its variations, preferably using varying thicknesses of integrally formed, continuous, energy dissipation material contoured to intimately contact and follow in face-to-face engagement the surfaces of the face over particular, selective pans of the facial skeleton. The Johnson safety helmet for vehicular use includes a separate shock liner shaped like an inverted bowl made of molded, viscoelastic (elastomer) thermoset polymer with a blowing agent located under the helmet shell.

The Marietta patent does provides a plastic "foot ball" player's mask with a separate, smoothly curved, concave, inner foam rubber pad of uniform thickness placed under an outer plastic layer to cover the player's face, which padding is not contoured to the face but smoothly curved. As can be seen in FIG. 3, the padding is flat when not smoothly curved around the player's face, rather than contoured in-and-out to intimately follow the complex, curved shape of the face, as in the invention.

With respect to the Strub patent, it only shows one large eye opening. Strub was not trying to prevent damage to the eyes or the face from blunt or penetrating trauma but only to protect them from the wind and cold, two formidable but totally different goals. Thus, Strub does not provide, for example, a more rigid framework over the nose, frontal bones or bony orbital rims, as in the invention.

Aileo mentions the use of polycarbonate for a visor or shield. However, the Aileo visor is moveable and attached with straps or fasteners and is not rigidly held in place to prevent displacement from blunt force, as in the invention. With respect to any suggested combination of the disclosures of Aileo and Strub patents, as noted above, Strub describes his protective mask as including "eye shields" to keep out wind and cold. There is no mention of any protection from blunt or sharp traumas or the desirability of such. Thus, it would not be "obvious" for Strub to use polycarbonate, a shatter-proof, extremely durable material used to protect against blunt and penetrating trauma in the invention. The two situations are completely different.

GENERAL DISCUSSION OF INVENTION

Thus, the present invention is directed to a protective facial mask system intimately contoured to the user's face and having an outer, high impact layer (e.g. a polycarbonate) and an inner, soft layer of energy absorption and dissipating material (e.g. an unaerated viscoelastic polymer). The inner, soft layer preferably has variable or different thicknesses of integrally formed, contiguous material (e.g. going from about an eighth of an inch to about a quarter inch), in order to afford greater protection to facial areas where the facial bone structure is weakest, i.e. where bone structures are more susceptible to fracture, which is where in accordance with the invention the inner layer is thicker, and, accordingly, thinner over the stronger bone structures.

By such an approach, high impact forces, even those over a very vulnerable area, are effectively redirected, transmitted to and dissipated more where the facial bone structure is stronger, such as in the supra-orbital/glabella, zygomatico-maxillary and masomaxillary regions, particularly the first two regions, while the weaker bone areas, particularly the nasal region, as well as preferably also the zygomatic arch and inferior orbital regions, are covered with a greater thickness of the energy absorbing material. The inner, soft layer thereby best absorbs, redirects and dissipates the energy from impact forces to the face, redirecting the impact forces to the stronger bone structure areas, protecting to a greater extent the facial skeleton from, for example, fracturing.

Additionally, the present invention is generally directed to a contoured, two layered, protective face mask system, intimately following and in face-to-face contact with the face, in which the inner layer is specifically made of an unaerated viscoelastic polymer which contacts the face at least at the main, centrally located buttresses of the facial bone structure, in particular, the nasomaxillary superior orbital, zygomaticofrontal, zygomatic arch, zygomaticomaxillary, pterygomaxillary and inferior orbital regions, as well as, in some applications, the maxilla region.

In the preferred, exemplary embodiments the mask is constructed of a unitary, two-layered, co-extensive, adhered portions, or with the inner layer extending past the outer layer, and is secured on the user's head with the use of straps, ties, or the like. The two-layered construction presents an outer, hard, impact resistant shell made preferably from a resinous material, for example, a polycarbonate, while the inner, integrally formed, continuous layer is formed preferably from a viscoelastic polymer, with an inner layer of varying thickness, although a uniform thickness is possible, although less preferred, in some applications.

The mask is constructed to be contoured to closely and intimately contact the skin of the user in face-to-face surface contact, with the mask being contoured to follow the complex contours of the face. Both the outer shell and the inner, soft layer are contoured to follow the complex contours of the face, with particularly the inner or interior side of the inner layer being more closely contoured to central part of the face. Thus, because of the presence of the varying thicknesses of the inner layer, its interior side will be closely following the complex contours of the face, while the outer shell will be a little bit less so.

The mask can be custom made, for example, by first making a plaster cast of the user's face and then molding the resinous and polymer material to conform to a set cast. Alternatively, the mask can also be mass produced in various sizes (e.g., small, medium and large).

When in use, the mask dissipates point or highly localized impact into a greater surface area, thus lessening and considerably decreasing the force of the impact on a particular area of the user's face. Additionally, with varying thicknesses of the energy absorbing layer, the impact forces are redirected to the stronger, buttressing areas of the face.

It is thus a specific object of the present invention to provide a face mask which allows dissipation of impact forces inflicted on a face of the user throughout a considerably greater area and directing as much force as feasible to the stronger areas of the face, thus decreasing the effective deleterious force of the impact.

It is another object of the present invention to provide a face mask of a simple construction having a hard outer shell and a soft, flexible, inner layer closely adapted to contact in face-to-face engagement the facial skin of the user, with the inner layer preferably having a lesser thickness over the stronger bone areas, and a greater thickness over the weaker bone areas.

It is a further object of the present invention to provide a face mask which uses an inner layer made of an unaerated viscoelastic polymer which contacts the face at least at the main, centrally located buttresses of the facial bone structure, in particular, the nasomaxillary, superior orbital, zygomaticofrontal, zygomtic arch, zygomaticomaxillary, and inferior orbital regions, as well as, in some applications, the maxilla and mandible region.

It is a further object of the present invention to provide a face mask which provides protection of the orbital bones, zygomatico-maxillary bones, nasal bones and frontal bones of the user. It is still a further object of the present invention to provide such a face mask which also provides protection of the mandible and maxilla.

These and other objects of the present invention are achieved through provision of a facial mask covering at least the supra-orbital ridges, a part of the frontal bone, the zygomatic bones and the nasal bones. The mask in an alternative embodiment also protects at least a part of the mandible and maxilla in the subnasal region.

BRIEF DESCRIPTION OF DRAWINGS

For a further understanding of the nature and objects of the present invention, reference should be made to the following detailed description, taken in conjunction with the accompanying drawings, in which some of the like elements are given the same or analogous reference numbers and wherein:

FIG. 8 is a perspective view, similar to that of FIG. 7, but with the supplemental, protective goggles shown in FIG. 7 removed, more fully exposing the mask of the invention, with the left and right eye openings including their own protective lens; while

FIGS. 11 is a frontal view of the human cranial facial region showing the classification of the facial bones into relatively high and low resistances to impact, using "G" force numbers; while

MODES FOR CARRYING OUT THE INVENTION

Figure 1:
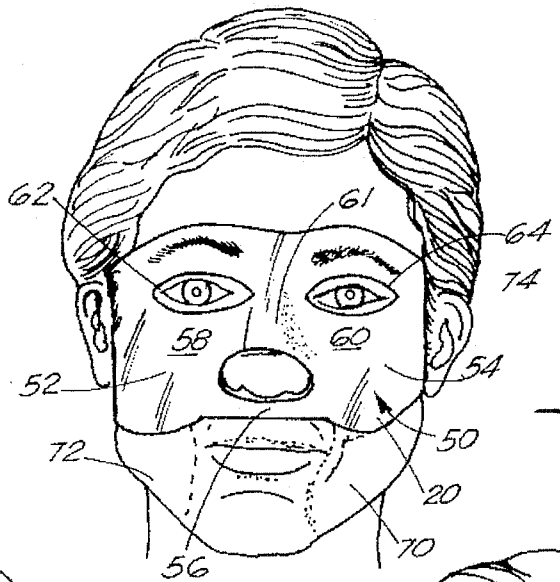
FIG. 1 is a perspective view of a first exemplary embodiment of the protective face mask of the invention positioned on a human face.
Figure 2:
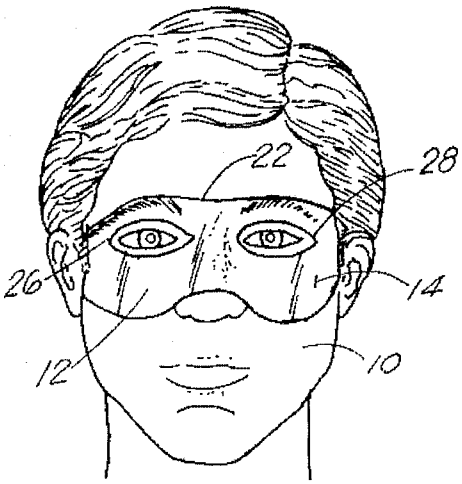
FIG. 2 is a side view of the mask illustrated in FIG. 1.

1st, Exemplary Embodiment (FIGS. 1 & 2)

Reference will now be made to FIGS. 1 & 2, wherein a first, exemplary embodiment of the present invention is illustrated. As can be seen in the drawings, the contoured mask 10 preferably is formed as a unitary, continuous shield and comprises a first portion 12 and a second portion 14, which are side-by-side and mirror images of each other.

Each portion (12 & 14) comprises a curved part 16 covering the zygomatic bones and extending in its lower region along the perimeter line 18 below the body of the zygoma, and extending in its upper region 20 over a zygomatictemporal bone towards the frontal bone. The uppermost part 22 of the shield 10 extends at a level above the supra-orbital ridges, so as to cover the outer perimeter of the orbital rims of the user.

Along the central, lowermost perimeter line 24, the mask 10 extends across the nasal bones and cartilage of the user, leaving the nostrils open to allow free breathing. A pair of oval openings 26 & 28 are formed in the portions 12 & 14, respectively, the openings being smaller than the bony orbital openings of the human skull but large enough to allow opening and closing of the eyes of the user without obstruction.

One or more head straps 30, 32 are securely attached to the outer edges of the side, end portions 16 & 18 to allow the securing of the mask 10 on the user's head.

It is preferred that the mask 10 be "custom-made," that is conformed precisely to the facial contours of the user. For this purpose, a plaster cast of the user's face is made from dental plaster of paris, and the mask 10 is then molded exactly to conform to the cast. Although, as previously stated, the masks could also be made generically in various sizes.

Figure 5:
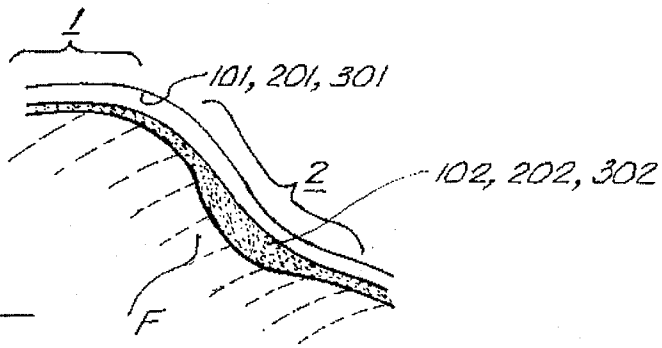
FIG. 5 is a cross-sectional view along a side edge of a portion of the mask wall, showing the varying thicknesses of the inner, energy dissipating material used on the underside of the mask and the intimate contouring of the interior side of the mask to match that of selected parts of the user's face.
Figure 8:
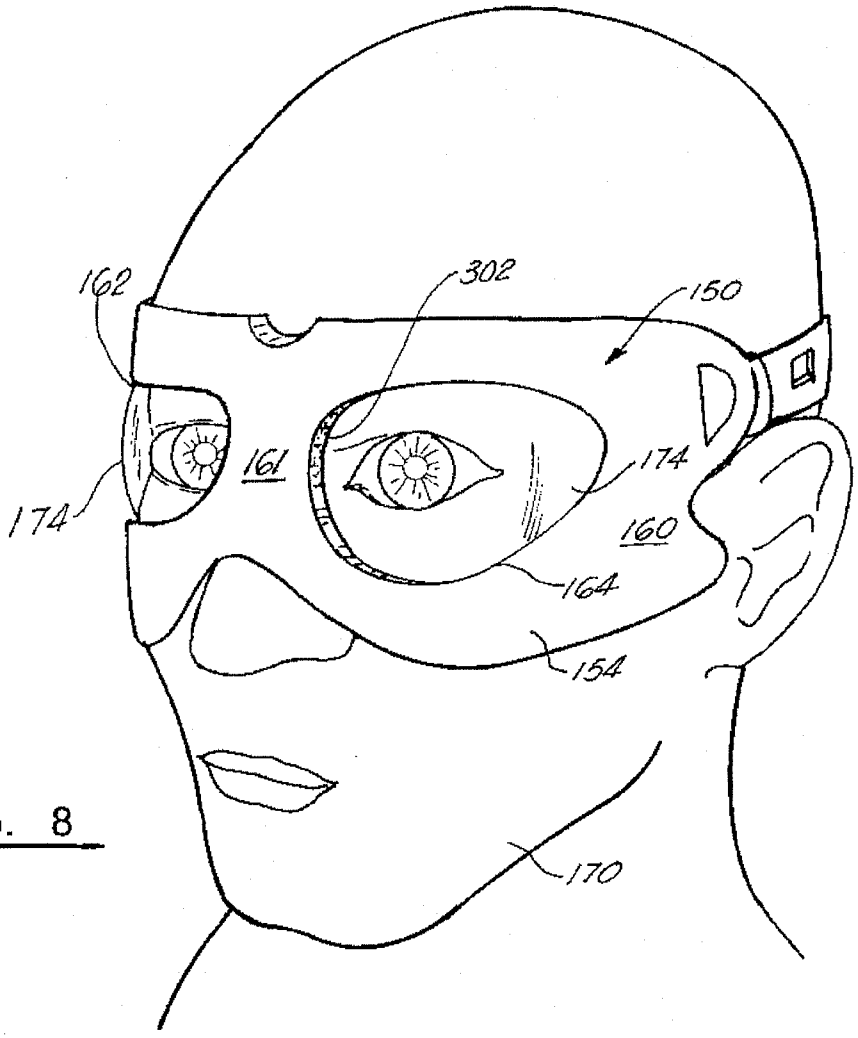
Figure 9:
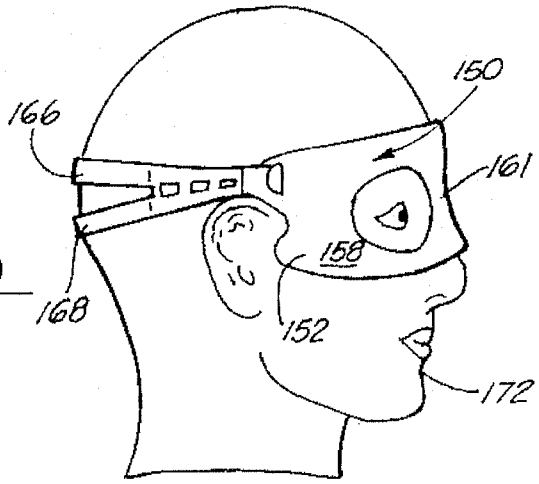
FIG. 9 and FIG. 10 are side and frontal views, respectively, of the embodiment of FIG. 8.
Figure 10:
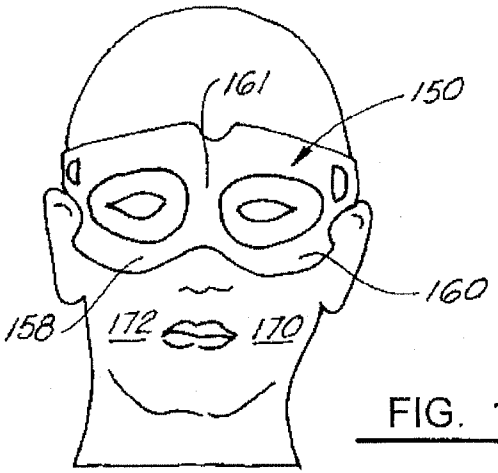

The mask 10 is formed from two layers. The first, outer layer 101 (see also FIG. 5) forms a sturdy, high impact shield, which receives the blows inflicted on the user's face, and a second, inner, soft, flexible layer 102, which absorbs and dissipates the blow, by distributing the energy of the impact through the greater surface area of the mask 10.

The outer layer 101 can be made from a thermoplastic resin, for example, polycarbonate having, for example, a thickness of about five (5 mm) millimeters or about three sixteenths (3/16") of an inch, which is a non-corrosive, non-toxic, synthetic material having high impact strength and a high degree of stability. The outer shield layer can be formed by a number of molding methods, for example extrusion, thermmoforming, etc.

Polycarbonate is a transparent resin, and it does not impede the eyesight of the user in any considerable way. However, the shell layer of the mask 10 can be also made from opaque or translucent materials, if so desired.

The inner, continuous layer 102 can be formed from, for example, a unaerated, viscoelastic polymer, such as that available in connection with the trademark "SORBATHANE", a material which is easy to mold and which is secured to the outer layer 101 in face-to-face engagement by thermofusion, adhesion or other convenient methods. It is preferred also that the inner layer 102 be made as a continuous, unitary surface of integrated material.

The inner layer 102 closely contacts the skin of the user, conforming to all the surfaces it covers, thus allowing dissipation of the impact force throughout the surface area of the inner layer. Also, as detailed below, the inner layer 102 preferably has varying thicknesses, depending on the structural strength of the underlying bone structure which the layer covers at that particular location. Preferably, as noted, the inner layer 102 intimately follows in face-to-face contact with the face, with the inner layer specifically made of an unaerated viscoelastic polymer, which contacts the face at least at the main, centrally located buttresses of the facial bone structure, in particular, the nasomaxillary, superior orbital, zygomaticofrontal, zygomatic arch, zygomaticomaxillary, pterygomaxillary and inferior orbital regions (see FIG. 5), as well as, in some applications, the maxilla region.

It is also envisioned that a pair of shatter-proof, polycarbonate lenses be inserted within the orbital opening 26 and 28 to further protect the eyes of the user against any possible impact.

Figure 3:
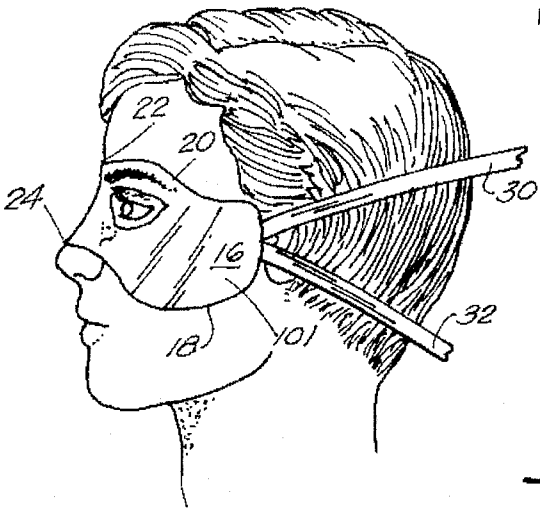
FIG. 3 is a perspective view of a second, exemplary embodiment of the protective face mask of the present invention positioned on a human face.
Figure 4:
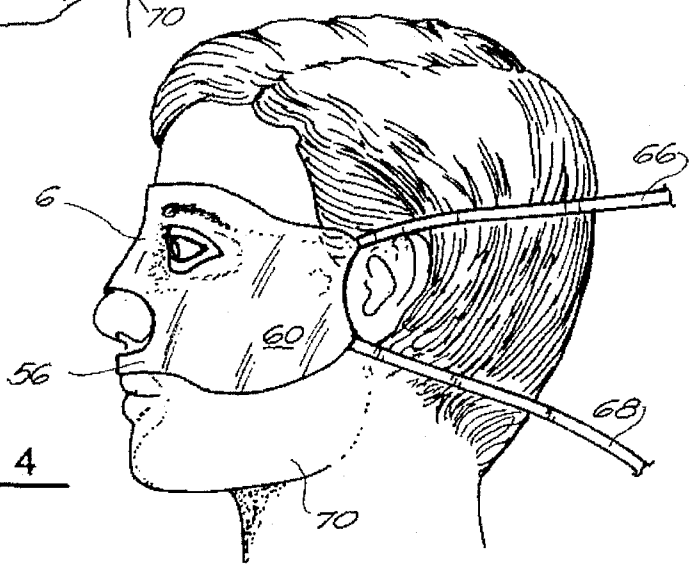
FIG. 4 is a side view of the mask illustrated in FIG. 3.

2nd, Exemplary Embodiment (FIGS. 3 & 4)

Referring now to the second embodiment illustrated in FIGS. 3 & 4, the mask 50 is illustrated as likewise comprising a pair of side-by-side, similar portions 52 & 54, which are side-by-side and mirror images of each other. The mask 50, in addition to covering the supra-orbital ridges and temporal, and zygomatic bones of the user, is seen to also comprise a sub-nasal extension part 56. This part is formed co-extensively with the side portions 58 and 60 and covers the maxilla and at least a part of the upper lip of the user. The nasal bones are covered by a nasal bridge portion 61, which is formed co-extensively with the side portions 58 & 60.

Similarly to the portions 16 & 18 of the embodiment of FIGS. 1 & 2, the portions 58 & 60 are formed with a pair of oval openings 62 & 64, which protect the openings of the eyes and extend up onto the frontal bone. A pair of straps 66 & 68 (see FIG. 4) extend from the side, end edges of the side portions 58 & 60 to allow securing of the mask 50 on the head of the user by tying or otherwise attaching to similar straps (not shown) attached to the portion 58.

It is also envisioned that additional (optional) extension portions may be included as part of the mask 50 to protect the facial areas 70 & 72 and made co-extensively with the portions 60 & 58, respectively, to protect at least the sides of the maxilla and mandible, leaving the chin and the mouth of the user open. It is particularly envisioned that the extensions over the facial areas 70 & 72 would be particularly appropriate for use in baseball or other sports which may cause injury to the mandible and destruction of the teeth of the user. These extensions could be either unilateral or bilateral.

The embodiment 50 of FIGS. 3 & 4, similarly to the embodiment 10 of FIGS. 1 & 2, is formed from a polycarbonate outer shield and a unaerated visco-elastic polymer inner layer, so that the hard plastic outer shell 201 receives the impact of the force, while the soft, elastic, inner layer 202 (see FIG. 5) distributes, absorbs and dissipates the strength of the impact through a considerably greater area. Also, as detailed below, the inner layer 202 preferably has varying thicknesses, depending on the structural strength of the underlying bone structure which the layer covers at that particular location.

If desired, shatter-proof polycarbonate lenses 74 can also be secured within the optical openings 62 & 64 to protect the eyes of the sportsman.

It is also preferred that the mask 50, similarly to the mask 10, be "custom-made," that is closely conforming to the facial contours of the user. Similarly, a plaster cast is made of the user's face and the inner and outer layers of the mask 50 are molded to conform exactly to the set cast. Alternatively, the mask 50 (as mask 10) could also be made generically in various sizes designated, for example, as small, medium or large, if so desired.

The viscoelastic polymer used for the inner layer is non-irritating, is not known to cause abrasions of the skin, and, since the layer has no seams or stitches, it is comfortable in its contact with the skin.

Variations In Thicknesses of Inner Layer of Mask (FIGS. 5 & 6 and 11 & 12)

In order to best and most cost effectively protect the human facial skeleton of the user, the inner or underlying, energy absorption layer of unaerated viscoelastic polymer varies in its thickness, from, for example, a thickness of about an eighth (⅛") of an inch in the thinner layers 1 over the stronger bone areas, and about a quarter (¼") of an inch in the thicker layers 2 over the weaker bone areas. As can be seen in the cross-sectional view of FIG. 5, the two types of areas 1 & 2, i.e. relatively thick and thin, have between them transitional areas 3 where the two are interconnected by smoothly curving interior surfaces intimately following the natural contours of the face F in a face-to-face surface engagement.

Figure 11:
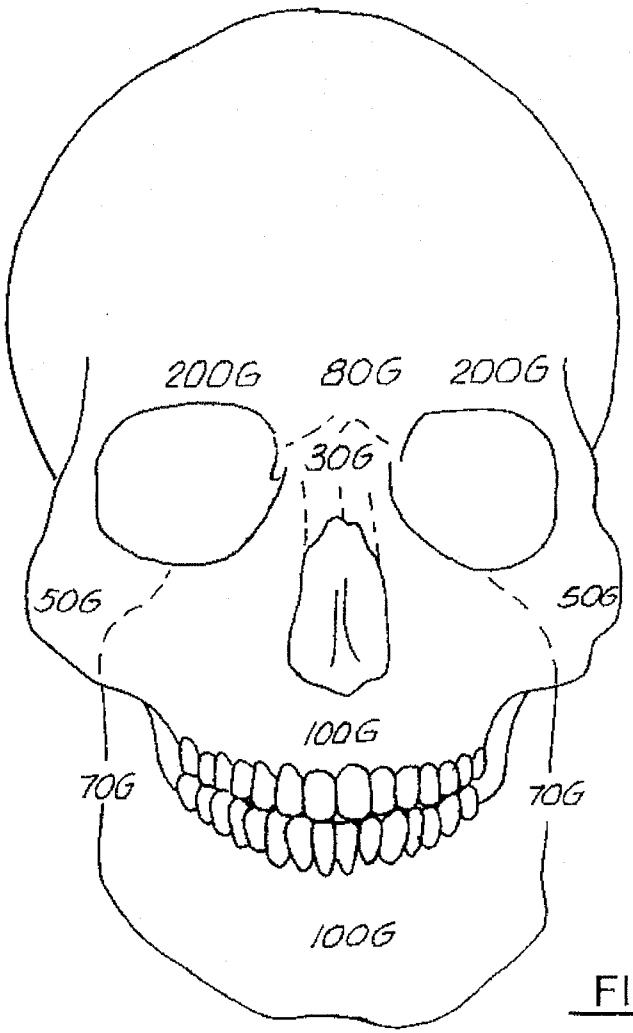

The diagram of FIG. 11 shows the human cranial facial region classifying the facial bones into relatively high resistance (higher "G" numbers) and relatively low resistance (lower "G" numbers) to impact designated by the "G" force impact typically necessary to fracture the bone structure involved, ranging from a low of 30 Gs in the nasal region up to 200 Gs in the flanking, supra-orbital/glabella regions.

Figure 12:
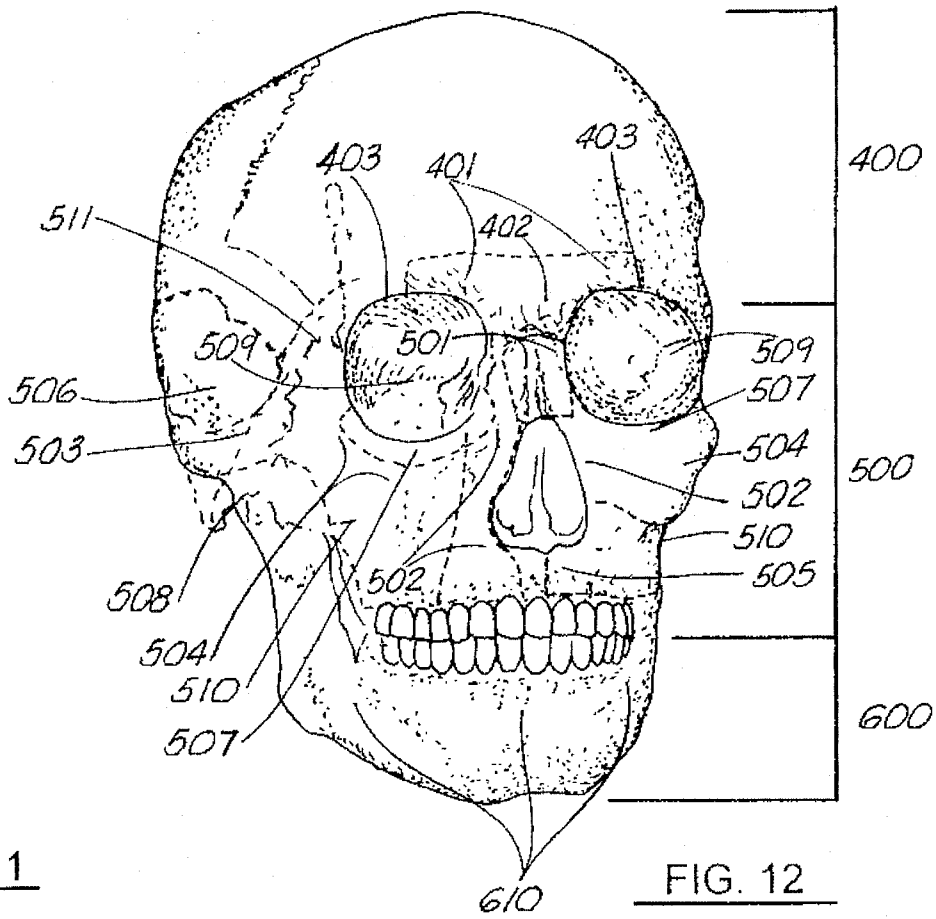
FIG. 12 is a perspective view of the human cranial facial region identifying its various areas or regions of the facial bones.

The illustration in FIG. 12 of the human cranial facial region, with its identifications of the facial regions further should clarify the regions where the inner layer 2 preferably is relatively thin and relatively thick. As is indicated in FIG. 12 the human cranial facial region is divided into three regions, the upper 400, the middle 500 and the lower 600. The particular facial areas are outlined below (with reference to both FIGS. 6 & 12):

| | |
|---|---|
| supra-orbital/glabella region | 401 |
| frontal sinuses | 402 |
| superior orbital | 403 |
| nasal bone area | 501 |
| nasomaxillary buttresses | 502 |
| zygomatic arch | 503 |
| zygomaticomaxillary complex | 504 |
| maxilla region | 505 |
| temporal bones | 506 |
| inferior orbital (sinus) | 507 |
| condyle | 508 |
| orbits | 509 |
| pterygomaxillary | 510 |
| zygomaticofrontal | 511 |
| mandible | 601 |

The stronger bone areas are indicated by right-leaning cross-hatching [e.g., the supra-orbital/glabella (200 Gs), zygomaticomaxillary, nasomaxillary and maxilla (100 Gs) regions], while the weaker bone areas are indicted by left-leaning cross-hatching [e.g., the nasal area (30 Gs), the temporal bones and zygomatic arches (50 Gs)].

Figure 6:
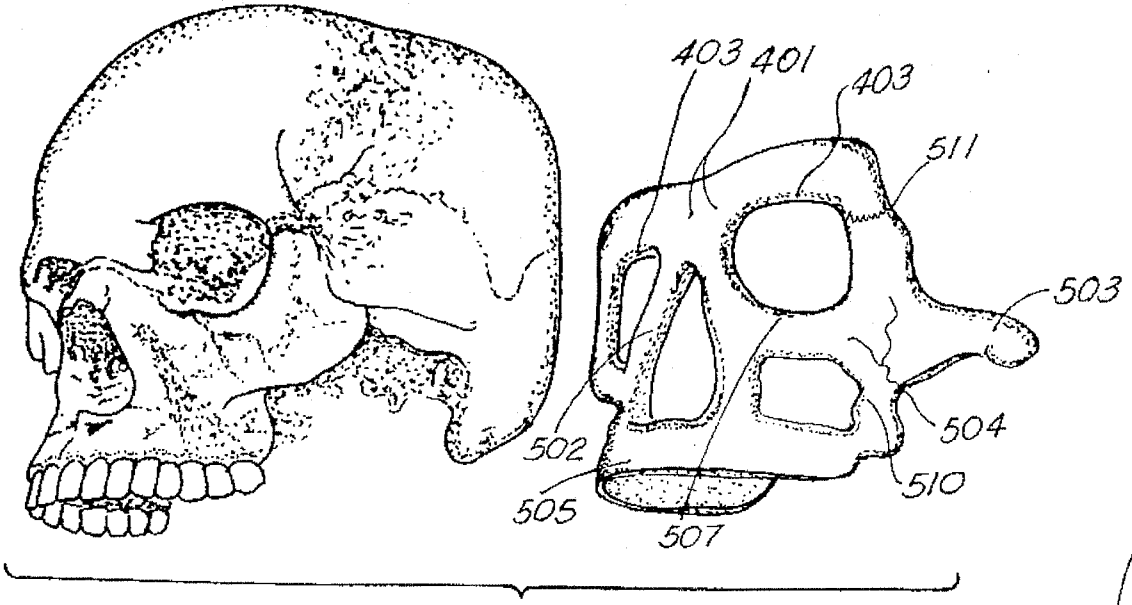
FIG. 6 is a perspective view of the primary energy dissipation parts of an embodiment (right side of figure) of the mask of the invention, in which the major buttresses of the human skeleton are labeled, along side of a perspective view of the human cranial facial region (left side of figure), for general reference purposes for identifying the areas of the mask in which the underlying energy absorption material is thicker and thinner.

The preferred location of the thinner and thicker regions 1, 2, respectively, of the inner, energy absorption layer (102/202/302) are outlined in the following table, referencing the skeletal facial regions illustrated and labeled in FIGS. 6 & 12.

| Facial Region | Thinner Layer 1 | Thicker Layer 2 |
|---|---|---|
| supra-orbital/glabella | X | |
| nasal | | X |
| zygomaticomaxillary | X | |
| zygomatic arch | | X |
| inferior orbital | | X |
| nasomaxillary | X | |

It is particularly important that the supra-orbital/glabella and the zygomaticomaxillary areas have the thinner, inner layers (1) in order to have the maximum amount of the impact blows be dissipated in at least these areas, while at least the nasal region has the thicker, inner layer (2), as it is the most vulnerable to fracturing. However, the most preferred arrangement is that the relationships outlined in the table above be completely implemented in the mask (10/50/150) for maximum effectiveness.

3rd, Exemplary Embodiment (FIGS. 7–10)

Referring now to the third embodiment, illustrated in FIGS. 7–10, the mask 150 is illustrated to comprise a pair of similar portions 152 & 154, which are side-by-side and mirror images of each other. The mask 150, similarly to the embodiment 10 of FIGS. 1 & 2, covers the supra-orbital ridges and temporal, and zygomatic bones of the user, while the nasal bones are covered by a nasal bridge portion 162, which is formed co-extensive with portions 158 & 160.

Similarly to the side-by-side portions 16 & 18 and 58 & 60, respectively, of the first two embodiments, the portions 158 & 160 are formed with a pair of oval openings 162 & 164, which protect the openings of the eyes and extend up onto the frontal bone, i.e., the forehead. A set of straps 166 & 168 extend from the portion 160 to allow securing of the mask 150 on the head of the user by tying or otherwise attaching to similar straps attached to the portion 152.

The embodiment 150 of FIGS. 7–10, similarly to the embodiments 10 & 50 of FIGS. 1 & 2 and FIGS. 3 & 4, respectively, is formed from a polycarbonate outer shield layer 301 and a non-aerated viscoelastic polymer inner layer 302, so that the hard plastic outer shell receives the impact of the force, while the soft, elastic, inner layer distributes, absorbs and dissipates the strength of the impact through a considerably greater area. Also, as detailed above, the inner layer 302 preferably has varying thicknesses, depending on the structural strength of the underlying bone structure which the layer covers at that particular location. As is also true for the contoured masks 10 & 50, there is face-to-face, surface contact at the interface between the outer and the inner layers 1 & 2, with the interior, under side of the outer layer being completely underlaid by the inner layer.

Figure 7:
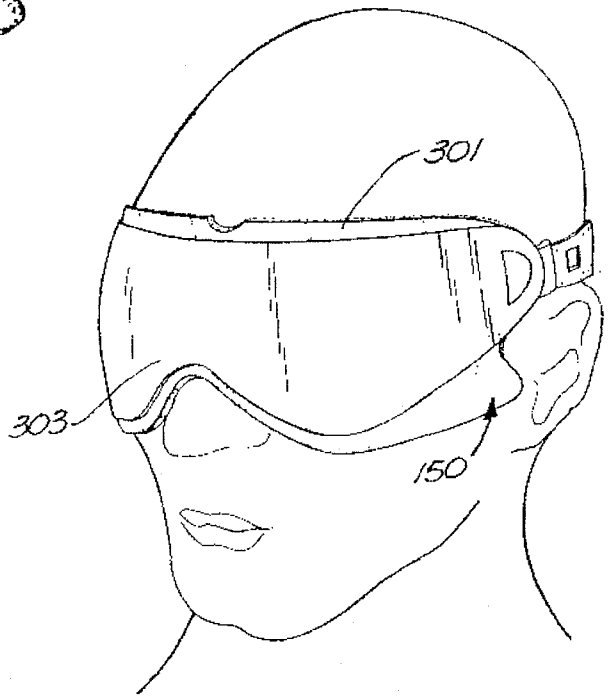
FIG. 7 is perspective view of another, exemplary embodiment of the protective face mask of the invention, which has over the central portion of it a supplemental, protective, transparent goggle, with the embodiment of the mask again having two, main, layers, including the outer, high impact outer protective piece of transparent material (in addition to the supplemental goggles) and the underlying energy adoption layer of material of varying thicknesses.

However, as can be seen in FIG. 7, the peripheral edges of the inner layer 302 of the mask 150 extend out past the peripheral edges of the outer layer or shield 301. Also, as can be seen in comparing FIGS. 7 & 8, the protective goggles or shield 303 and the mask 150 are two separate, independent pieces, readily separable from one another but held together by the backwardly directed force of the straps 166 & 168. The underside or interior side of the inner layer 302 and the facial surfaces of the user, and the outer, exterior side of the inner layer and the underlying or interior side of the outer shell form complexly curved, complementary, interfacing surfaces contacting one another in face-to-face interfacing engagement, with the latter two mask layers being adhered together.

If desired, shatter-proof polycarbonate lenses 174 can also be secured within the optical openings 162 & 164 to protect the eyes of the sportsman.

It is also preferred that the mask 150, similarly to the masks 10 and 50, be "custom-made," that is closely conforming to the facial contours of the user. Similarly, a plaster cast is made of the user's face and the inner and outer layers of the mask 150 are molded to conform exactly to the set cast. Alternatively, mask 150 (like masks 10 & 50) could also be made generically in various sizes designated, for example, as small, medium or large, if so desired.

It is noted that, unless otherwise indicated, the masks of the three embodiments (10, 50 & 150) are very similar and some instances identical in many respects, with the primary differences between them being that the mask 50 has an added part extending under the nose, and the mask 150 includes a separably goggle (FIGS. 7) in which the two parts 150 & 303 are not adhered together. For the sake of brevity, not all of the common details for each is repeated.

While the present invention has been shown and described in what has at this time believed to be most practical and preferred embodiments, it is recognized that departures may be made therefrom within the scope of the invention, which is therefore not to be limited to the details disclosed herein, but it is to be accorded the full scope of the claims as to embrace any and all equivalent devices and approaches.

Hence, the embodiments described herein in detail for exemplary purposes are subject to many different variations in structure, design, application and methodology. Because many varying and different embodiments may be made within the scope of the inventive concept(s) herein taught, and because many modifications may be made in the embodiments herein detailed in accordance with the descriptive requirements of the law, it is to be understood that the details herein are to be interpreted as illustrative and not in a limiting sense.

I claim:

1. A protective face mask adapted to be worn on a person's head over at least a portion of the cranial facial region, comprising:

a high-impact resistant, relatively rigid, outer shell, shield layer having an underside and an exterior surface, said outer layer being laterally extended sufficiently to substantially cover at least the orbital, nasal and zygomatic bone areas of the person and extending laterally towards the temporal bone and the frontal bone areas of the person's face; and a flexible, energy absorbing and dissipating inner layer, having an interior side which is complexly contoured to closely follow the contours of and conform to the person's face for placement in intimate, face-to-face contact with the person's face at least the orbital, nasal and zygomatic bone areas, and an outwardly directed side underlying said outer shell at least the orbital, nasal and zygomatic bone areas and located in face-to-face surface contact with said underside of said outer layer, said outer layer having a complexly curved shape on its interior side at least generally following the complex contours of the person's face, said inner layer being sized to underlay at least the underside of said outer shield layer.

2. The mask of claim 1, wherein:

said inner, energy absorbing layer has varying thicknesses, depending on the structural strength of the underlying bone structure which said layer covers at particular locations.

3. The mask of claim 2, wherein:

said inner layer has a greater thickness in at least one area overlying a weaker bone structure in the user's cranial facial region; and said inner layer has a lesser thickness in at least one area overlying a stronger bone structure in the user's cranial facial region.

4. The mask of claim 2, wherein:

said inner layer has a greater thickness in at least one area overlying a weaker bone structure in the user's cranial facial region; and said inner layer has a lesser thickness in at least one, different area overlying a stronger bone structure in the user's cranial facial region.

5. The mask of claim 4, wherein:

said one area is the nasal region; and said one, different area includes the flanking, supraorbital/glabella regions.

6. The mask of claim 5, wherein:

said at least one area further includes the zygomatic arch and inferior orbital regions; and said at least one, different area further includes the zygomaticomaxillary and nasomaxillary regions.

7. The mask of claim 2, wherein:

the varying thicknesses of said inner, energy absorbing layer have a thickness of about an eighth (⅛") of an inch in the thinner layers over the stronger bone areas, and about a quarter (¼") of an inch in the thicker layers over the weaker bone areas.

8. The mask of claim 1, wherein: there is face-to-face, surface contact between said inner and said outer layers, with said underside of said outer layer being completely underlaid by said inner layer, said two layers being affixedly adhered together.

9. The mask of claim 1, wherein said mask further includes:

an outer goggle shield positionable over and temporarily held over said outer shell layer, the goggle shield and the mask being two separate pieces readily separable from one another and held together by the backwardly directed force of strap means, with said goggle shield forming a smoothly curved, exterior surface.

10. The mask of claim 1, wherein:

said outer shield layer is formed from a synthetic, thermoplastic resin.

11. The mask in claim 10, wherein:

said resin is polycarbonate.

12. The mask in claim 1, wherein:

said inner layer is formed from a viscoelastic polymer.

13. The mask in claim 12, wherein:

said viscoelastic polymer is unaerated.

14. The mask in claim 1, further comprising:

a lower extension part having a surface area sufficient to substantially cover the maxilla bone, said lower extension part being formed co-extensively with mask portions adapted for covering the zygomatic bone.

15. The mask of claim 1, further comprising:

a pair of co-extensive members, each member being sufficient to cover at least a side of the mandible.

16. The mask of claim 1, wherein:

a pair of separate openings are formed in said outer and inner layers at eye level, and a shatter proof lens is secured in each of said openings.

17. A protective face mask adapted to be worn on a person's head over at least a portion of the cranial facial region, comprising:

a high-impact resistant, relatively rigid, outer shell, shield layer having an underside and an exterior surface, said outer layer being laterally extended sufficiently to substantially cover at least the orbital, nasal and zygomatic bone areas of the person and extending laterally towards the temporal bone and the frontal bone areas of the person's face; and a flexible, energy absorbing and dissipating inner layer, having an interior side which is complexly contoured to closely follow the contours of and conform to the person's face for placement in intimate, face-to-face contact with the person's face at at least the orbital, nasal and zygomatic bone areas, and an outwardly directed side underlying said outer shell at at least the orbital, nasal and zygomatic bone areas and located in face-to-face surface contact with said underside of said outer layer and having a complexly curved shape on its interior side following the complex contours of the person's face, said inner layer being sized to underlay at least the underside of said outer shield layer, said inner, energy absorbing layer having varying thicknesses, depending on the structural strength of the underlying bone structure which said layer covers at particular locations, said inner layer having a greater thickness in at least one area overlying a weaker bone structure in the user's cranial facial region, including the nasal, zygomatic arch and inferior orbital regions, and said inner layer having a lesser thickness in at least one, different area overlying a stronger bone structure in the user's cranial facial region, including the flanking, supra-orbital/glabella, zygomaticomaxillary and nasomaxillary regions.

18. The mask of claim 17, wherein:

the varying thicknesses of said inner, energy absorbing layer have a thickness of about an eighth (⅛") of an inch in the thinner layers over the stronger bone areas, and about a quarter (¼") of an inch in the thicker layers over the weaker bone areas.

19. The mask of claim 17, wherein:

there is face-to-face, surface contact between said inner and said outer layers, with said underside of said outer layer being completely underlaid by said inner layer, said two layers being affixedly adhered together.

20. The mask of claim 17, wherein said mask further includes:

an outer goggle shield positionable over and temporarily held over said outer shell layer, the goggle shield and the mask being two separate pieces readily separable from one another and held together by the backwardly directed force of strap means, with said goggle shield forming a smoothly curved, exterior surface.

21. The mask of claim 17, wherein:

said outer shield layer is formed from polycarbonate; and said inner layer is formed from an unaerated viscoelastic polymer.

22. The mask in claim 17, further comprising:

a lower extension part having a surface area sufficient to substantially cover the maxilla bone, said lower extension part being formed co-extensively with mask portions adapted for covering the zygomatic bone.

23. A protective face mask adapted to be worn on a person's head over at least a portion of the cranial facial region, comprising:

a high-impact resistant, relatively rigid, outer shell, shield layer having an underside and an exterior surface, said outer layer being laterally extended sufficiently to substantially cover at least the orbital, nasal and zygomatic bone areas of the person and extending laterally towards the temporal bone and the frontal bone areas of the person's face; and a flexible, energy absorbing and dissipating, unaerated, viscoelastic inner layer, having an interior side which is complexly contoured to closely follow the contours of and conform to the person's face for placement in intimate, face-to-face contact with the person's face at at least the orbital, nasal and zygomatic bone areas, and an outwardly directed side underlying said outer shell at at least the orbital, nasal and zygomatic bone areas and located in face-to-face surface contact with said underside of said outer layer and having a complexly curved shape on its interior side following the complex contours of the person's face, said inner layer being sized to underlay at least the underside of said outer shield layer, said inner layer being contoured to rest on the user's cranial region at at least some of the cranial region's buttresses, including at least at the main, centrally located buttresses of the facial bone structure, in particular, the nasomaxil, superior orbital, zygomaticofrontal, zygomaticofrontal, zygomatic arch, zygomaticomaxillary, pterygomaxillary and inferior orbital regions.

24. The mask of claim 23, wherein:

said inner, energy absorbing layer has varying thicknesses, depending on the structural strength of the underlying bone structure which said layer covers at particular locations, said inner layer having a greater thickness in several areas overlying relatively weaker bone structures in the user's cranial facial region, including the nasal, zygomatic arch and inferior orbital regions, and said inner layer having a lesser thickness in several different areas overlying stronger bone structures in the user's cranial facial region, including the flanking, supraorbital/glabella, zygomaticomaxillary and nasomaxillary regions.

25. A method of making a mask for protecting the cranial facial region of a person, comprising the following steps:

a. providing a protective mask, including a high-impact resistant, relatively rigid, outer shell, shield layer having an underside and an exterior surface, said outer layer being laterally extended sufficiently to substantially cover at least the orbital, nasal and zygomatic bone areas of the person and extending laterally towards the temporal bone and the frontal bone areas of the person's face, and a flexible, energy absorbing and dissipating inner layer, having an interior side which is complexly contoured to closely follow the contours of and conform to the person's face for placement in intimate, face-to-face contact with the person's face at at least the orbital, nasal and zygomatic bone areas, and an outwardly directed side underlying said outer shell at at least the orbital, nasal and zygomatic bone areas and located in face-to-face surface contact with said underside of said outer layer, said outer layer having a complexly curved shape on its interior side at least generally following the complex contours of the person's face, said inner layer being sized to underlay at least the underside of said outer shield layer; and b. forming said inner, energy absorbing layer in varying thicknesses, based at least in part on the structural strength of the underlying bone structure which said layer covers at particular locations, producing greater thicknesses in at least one area overlying a relatively weaker bone structure in the user's cranial facial region, including at least the nasal region, and forming a lesser thickness in at least one other, different area overlying a stronger bone structure in the user's cranial facial region, including at least the flanking, supra-orbital/glabella regions.

26. The method of claim 25, wherein step "b" further includes the steps of:

also forming greater thicknesses in the inner layer over the zygomatic arch and inferior orbital regions, and lesser thicknesses in the inner layer over the zygomati-comaxillary and nasomaxillary regions.

* * * * *